United States Patent [19]

Jennings

[11] 4,353,179

[45] Oct. 12, 1982

[54] ROTATABLE SIGN

[76] Inventor: Hugh F. Jennings, 83 Anstead Crescent, Ajax, Ontario, Canada, L1S 3X4

[21] Appl. No.: 271,904

[22] Filed: Jun. 9, 1981

[51] Int. Cl.[3] ..... G09F 15/00

[52] U.S. Cl. ..... 40/479; 40/431; 40/607

[58] Field of Search ..... 40/479, 430, 480, 610, 40/412, 607

[56] References Cited

U.S. PATENT DOCUMENTS

| | | | |
|---|---|---|---|
| 895,892 | 8/1908 | Peters | 40/479 |
| 1,875,049 | 8/1932 | Lewis | 40/430 |
| 2,710,472 | 6/1955 | Leander | 40/479 |
| 2,833,065 | 5/1958 | Kies | 40/479 |

FOREIGN PATENT DOCUMENTS

| | | | |
|---|---|---|---|
| 128993 | 9/1948 | Australia | 40/479 |

*Primary Examiner*—Gene Mancene
*Assistant Examiner*—Wenceslao J. Contreras
*Attorney, Agent, or Firm*—Arne I. Fors; Robert F. Delbridge

[57] ABSTRACT

A rotatable sign adapted to be driven by air currents to provide successively changing indicia to a viewer is disclosed. Indicia formed of light-reflective material and mounted on a dark background is located at different levels on at least two of three side panels of the sign to provide the illusion of a vertically moving sign. The rotatable portion of the sign can be inverted to reverse the direction of rotation.

7 Claims, 8 Drawing Figures

FIG.3.
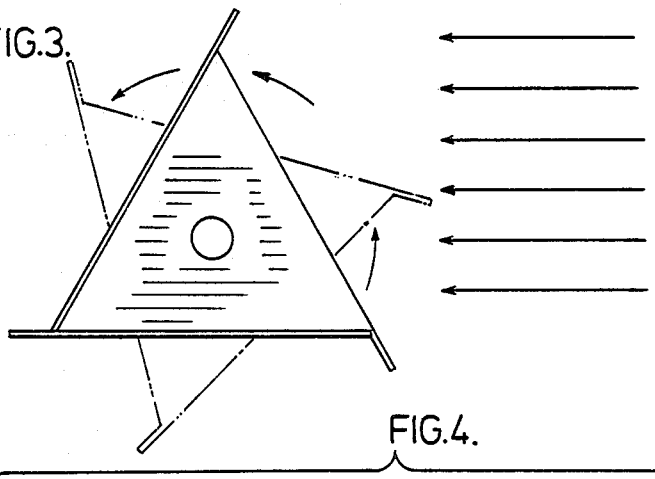
FIG.4.
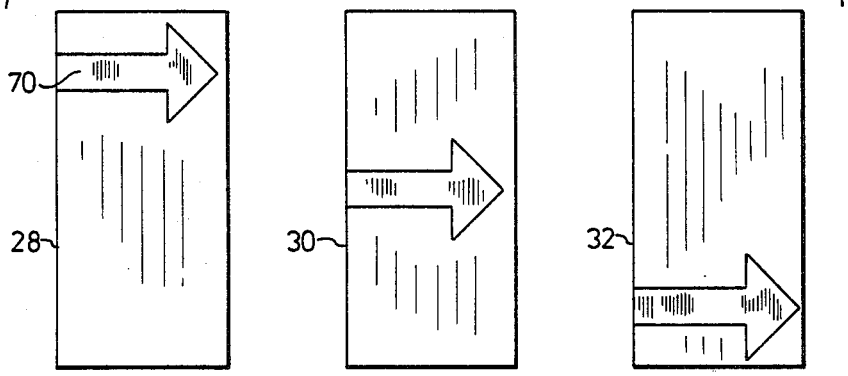
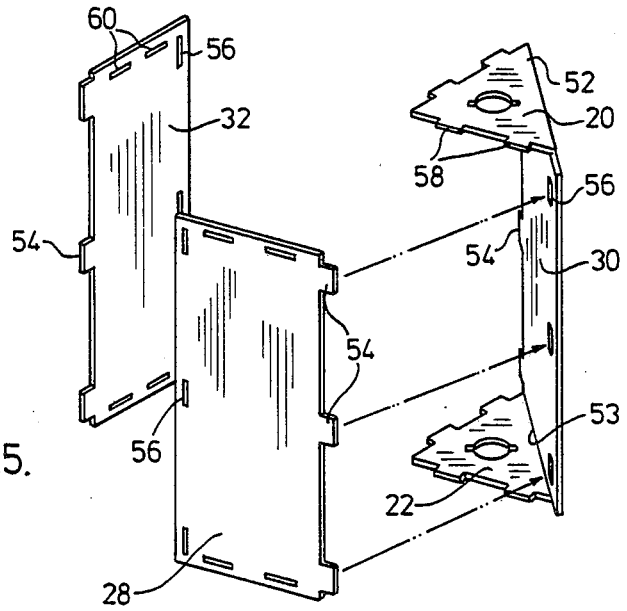
FIG.5.

ROTATABLE SIGN

BACKGROUND OF THE INVENTION

This invention relates to a rotatable sign adapted to be driven by air currents and, more particularly, relates to a rotatable sign adapted to be driven by air currents to provide successively changing indicia.

Wind driven display devices having vertically disposed wind-catching marginal portions are well known. For example, U.S. Pat. No. 2,710,472 discloses a rotatable display having four side panels with indicia provided thereon, said display having complex bearing means for rotatable support.

U.S. Pat. No. 2,766,539 discloses another version of upright rotatable display device having indicia on opposite sides with deflector vanes provided at the lateral edges. U.S. Pat. No. 2,833,065 relates to a sign-carrying windmill construction having a relatively complicated construction. U.S. Pat. No. 3,073,047 discloses a further embodiment of animated sign adapted to be rotated by currents of air for rotation in a single direction.

SUMMARY OF THE INVENTION

Conventional rotatable wind-driven signs generally are relatively complex in structure, rotate in one direction only and provide to the viewer a repeat of indicia in the same level. The present invention relates to a rotatable wind driven sign of simplified construction, which can be readily inverted for change in direction of rotation, and which will provide indicia in a different level, such as directional arrows flashing successively in a different level, e.g. top to bottom, pointing either to the right or to the left as observed by a viewer. The sign bears indicia which is formed of a reflective material which is highly visible during day or night.

It is the principal object of the present invention to provide an improved rotatable wind-driven sign which is simple in construction, can be readily inverted and is reliably driven by slow-moving air currents.

The structure of my invention comprises, in general, a sign rotatable by air currents comprising support means having a shaft portion adapted to be mounted in an upright position, and a rotor mounted for rotation on said shaft portion, said rotor including spaced-apart equilateral triangular end panels of the same size each having a central opening concentric with the other, three rectangular side panels extending between and secured at each end to a side of said end panels to form a closed box structure, one side of each of said side panels extending laterally beyond a side edge of an adjacent side panel to define a vane at each juncture of the side panels, a pair of removable bearing means mounted in the central openings of the end panels adapted to be interchanged to permit inversion of the rotor, one of said bearing means comprising a sleeve bearing for loosely receiving the shaft portion therein for facile rotation and the other of the said bearing means comprising a dome closure for receiving the end of the shaft portion therein for vertical support and rotation of the rotor, and indicia formed on at least two of the side panel faces out of axial alignment with each other for presenting said indicia on an alternating level as the sign rotates.

The removable bearing means preferably are secured to the central openings formed in the end panels by means of a bayonet-type connection, each of said bearings having a central opening for loosely receiving the shaft portion of the support means therein.

DESCRIPTION OF THE DRAWINGS

The structure of my invention will now be described with reference to the accompanying drawings, in which:

FIG. 3 is a plan view of the embodiment of my invention shown in FIG. 1 illustrating the effect of an air current on the apparatus;

FIG. 4 is a side elevation showing the three panels of the apparatus in the same plane to illustrate indicia formed thereon;

FIG. 5 is an exploded perspective view of an embodiment of the structure of my invention showing details of assembly;

DESCRIPTION OF THE PREFERRED EMBODIMENTS

Figure 1:
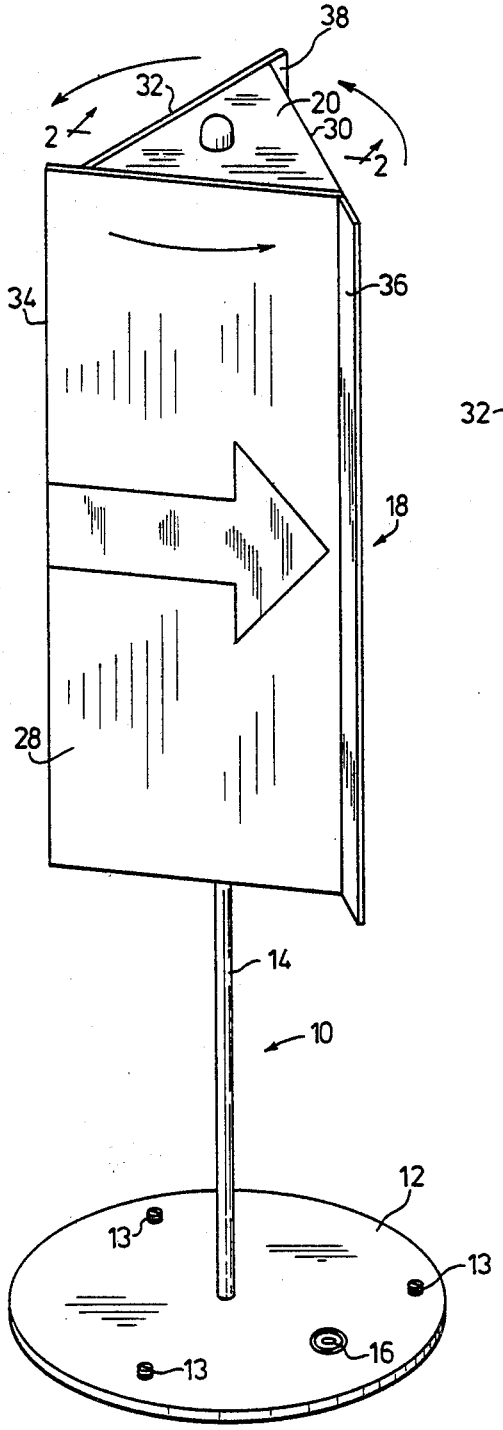
FIG. 1 is a perspective view of a rotatable sign of the invention in an operative position.
Figure 2:
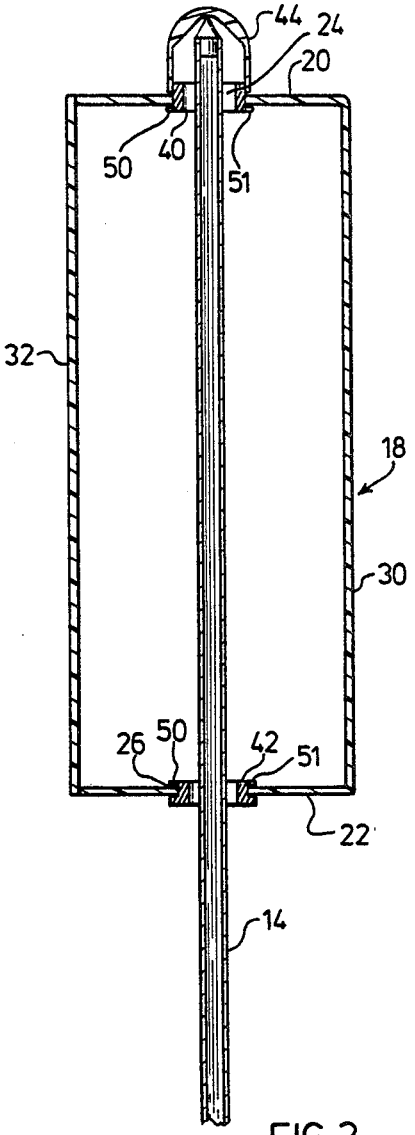
FIG. 2 is a longitudinal section, partly in elevation, taken along the line 2—2 of FIG. 1.

With reference to FIGS. 1 and 2, the structure of my invention comprises support means 10 consisting of a base 12 and a shaft 14 secured perpendicular thereto such that leveling of base 12 by means of leveling screws 13 with the aid of a bubble level 16 plumbs shaft 14.

Rotor 18 comprises end panels 20, 22 spaced axially apart such that central openings 24, 26 are concentric with each other. End panels 20, 22 are of equal size, each having an equilateral triangular configuration. Side panels 28, 30 and 32 are secured at their opposite ends to the side edges of end panels 20, 22 and along their sides to adjacent rectangular panels with one lateral edge of each panel overlapping the side edge of the adjacent panel to provide a vane 34, 36 and 38 at each juncture of the side panels. Panels 28, 30 and 32 and end panels 20, 22 can be formed of thin sheets of a plastic material such as glass fibre-reinforced polyester resin and the panels, as shown in this embodiment, joined together by means of compatible adhesive and resins well known in the art. End panels 20, 22 preferably have a double or triple thickness compared to side panels 28, 30 and 32.

Figure 6:
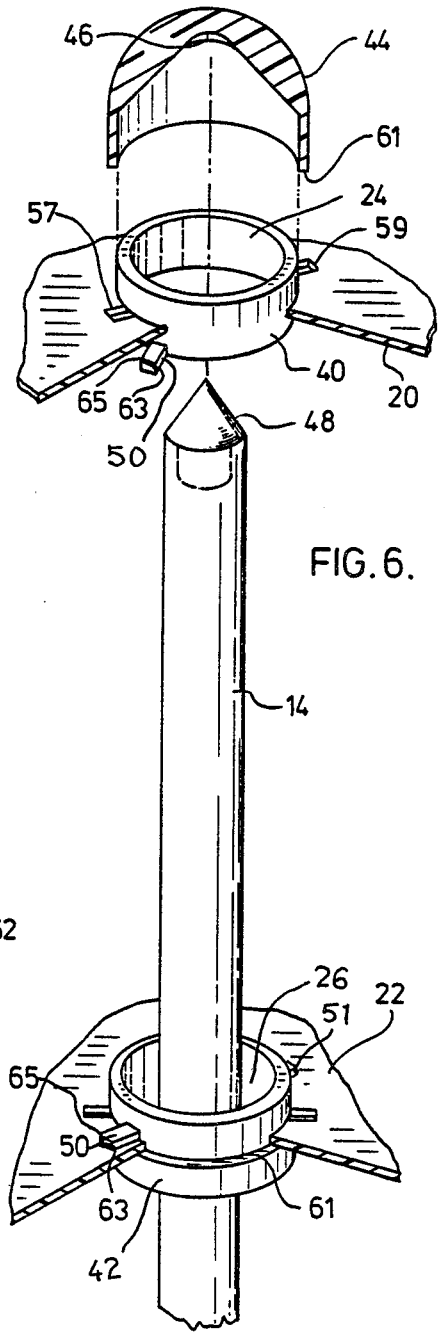
FIG. 6 is an exploded perspective view showing in detail the upper and lower bayonet connections.

Central openings 24, 26 formed in end panels 20, 22 respectively, receive bearings 40, 42 as typified by bearings 40, 42 shown in more detail in FIG. 6, each bearing having a central opening which provides a loose fit on shaft 14 to permit facile rotation of the shaft in the bearings. The upper bearing 40 is shown in the form of a dome closure 44 having an internal bore 46 for receiving the preferably pointed end 48 of an insert, e.g. a nylon insert, seated in tubular shaft 14. A pair of diametrically opposed lugs 50, 51 extending radially from the periphery of dome closure 44 is adapted to be inserted in mating recesses 57, 59 such that lugs 50, 51 will frictionally engage the underside of panel 20 while shoulder 61 seats on the upper surface of panel 20 as the closure 44 is rotated within opening 24.

The lower bearing 42 comprises a bushing or sleeve having a pair of diametrically opposed lugs 50, 51 and shoulder 61 of the same dimensions as upper bearing 40 but is open at both ends to permit shaft 14 to loosely slide therethrough. Lower bearing 42 is mounted in opening 26 of lower panel 22 in the same manner as upper bearing 40 is mounted in upper panel 20 to permit interchange of the bearings for reasons which will become apparent as the description proceeds.

Bearings 40, 42 can be readily manufactured from wear resistant plastics such as teflon or nylon by injection moulding or the like forming techniques. Lugs 50, 51 are rotated slightly out of plane in each other such that the leading edges 63 of the lugs will readily pass under the undersurface of the panels 20, 22 but the trailing edges 65 will frictionally engage the said undersurfaces.

FIG. 5 illustrates another embodiment of my invention wherein end panels 20, 22 are formed integral with a side panel 30 from a material such as rigid, thin plastic which can be precut and articulated along lines 52, 53.

Rectangular side panels 28, 32 are formed in like manner from thin, plastic sheet, each rectangular panel 28, 30 and 32 having equispaced tabs 54 formed along one side and mating recesses 56 formed in proximity to the opposite side to permit assembly of the side panels to each other with closure at each end by means of the end panels 20, 22. End panels 20, 22 inter-engage the ends of side panels 28, 32; tabs 54 adapted to be received in slots 56.

Figure 7:
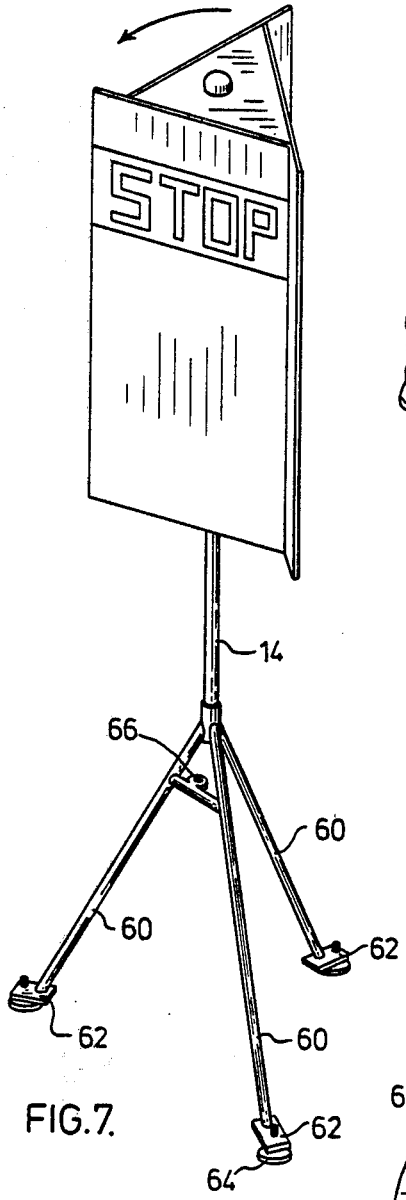
FIG. 7 is a perspective view of another embodiment of my invention showing support means and an alternate form of indicia.

FIG. 7 illustrates another embodiment of my invention in which the base comprises a tripod stand having legs 60 with support plate 62 formed at the bottom of each lower end, each support plate 62 having an adjusting screw 64 for plumbing shaft 14 by means of bubble level 66.

FIG. 4 illustrates an embodiment of my invention in which each panel 28, 30 and 32 has an arrow 70 formed thereon, such as by Scotchlite TM tape, on a black background, at a different level on the panel face such that as the sign rotates at night, as depicted in FIG. 3, a viewer observes the arrows intermittently from top to bottom of the sign indicating, for a traffic sign, movement of traffic to the right as viewed in FIG. 4. The sign can be easily inverted end-for-end by interchange of bearings 40,42 in the manner described hereinabove to reverse the direction in which the arrows point and direct traffic to the opposite direction, i.e. to the left.

The embodiment of FIG. 7 shows the word STOP on panel 28 and at least one of panels 30 and 32 has the same word STOP thereon, at a different level, to provide the visual effect of moving indicia on a stationary sign. The word SLOW can be shown on two or more panels, at different levels, in like manner. It will be understood that the indicia illustrated and described herein is exemplary only of types of indicia that can be used. The indicia will be formed of reflective material normally on a black background for use of the sign both day and night.

Figure 8:
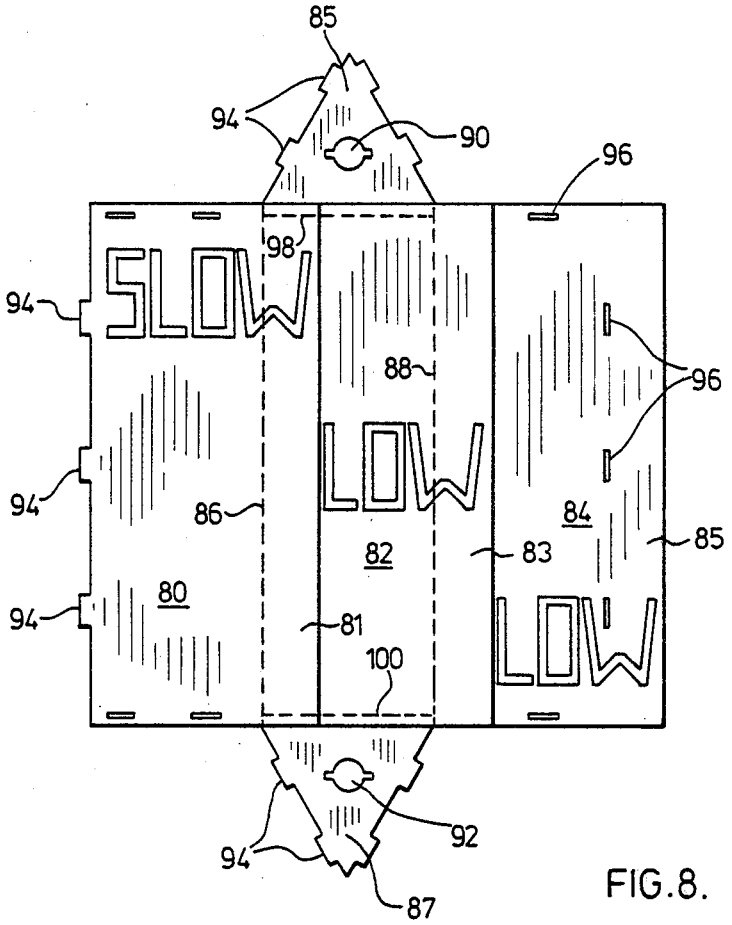
FIG. 8 is a plan view of another embodiment of my invention.

FIG. 8 shows another embodiment of my invention in which the three panels 80, 82 and 84 are extrusion moulded from a plastics material with an overlap 81, 83 past lines of weakness 86, 88. End panels 85, 87 with cut-out openings 90, 92 and the forming of tabs 94 and mating slots 96 are formed with a cutting die and lines of weakness 98, 100 are formed with a heated bar to permit folding of end panels 85, 87 for engagement by side panels 80, 84 by means of insertion of tabs 94 into slots 96.

The present invention provides a number of important advantages. Traffic signs can be readily fabricated from plastic sheet to provide a wind driven rotating sign usable day or night which gives the effect of a stationary sign with moving indicia, e.g. three arrows flashing from top to bottom. The sign can be readily inverted to reverse the direction of the sign.

It will be understood of course that modifications can be made in the embodiment of the invention illustrated and described herein without departing from the scope and purview of the invention as defined by the appended claims.

What I claim as new and desire to protect by Letters Patent of the United States is:

1. A rotatable sign adapted to be driven by air currents comprising support means having a shaft portion adapted to be mounted in an upright position, and a rotor mounted for rotation on said shaft portion, said rotor including spaced-apart equilateral triangular end panels of the same size each having a central opening concentric with the other, three rectangular side panels extending between and secured at each end to a side of said end panels to form a closed box structure, each of said side panels extending laterally beyond a side edge of an adjacent side panel to define a vane at each juncture of the side panels, a pair of removable bearing means each having a bayonet connection mounted in the central openings of the end panels adapted to be quickly interchanged to permit inversion of the rotor, one of said bearing means comprising a sleeve bearing for loosely receiving the shaft portion therein for facile rotation and the other of the said bearing means comprising a dome closure for loosely receiving the end of the shaft portion therein for vertical support and rotation of the rotor, and indicia formed on at least two of the side panel faces out of axial alignment with each other for presenting said indicia on an alternating level as the sign rotates.

2. A rotatable sign as claimed in claim 1 in which each of said sleeve bearing means bayonet connection for removable mounting within a central opening comprises a pair of diametrically opposed lugs extending radially from the bearing and adapted to be inserted within mating recesses extending from the central opening, and an annular shoulder formed on the bearing and spaced from the lugs adapted to seat on the end panel surrounding the opening whereby the lugs can be inserted through the mating recesses and the bearing rotated relative to the end panel for frictional engagement of the panel between the lugs and the shoulder.

3. A rotatable sign as claimed in claim 2 in which each of the three side panels has identical indicia formed thereon, said indicia in adjacent panels being out of axial alignment with each other for presenting the indicia on an alternating level as the sign rotates.

4. A rotatable sign as claims in claim 1 or 2 in which each of said side panels has indicia formed thereon, said indicia each comprising an arrow pointing in the same direction as the sign is rotated, each adjacent arrow being out of axial alignment with each other for presenting indicia at a different level in succession from top to bottom or bottom to top as the sign rotates.

5. A rotatable sign as claimed in claims 1, 2 or 3 in which the indicia is formed of a light-reflective material.

6. A rotatable sign as claimed in claims, 1, 2 or 3 in which the indicia is formed of a light-reflective material mounted on a black background.

7. A rotatable sign as claimed in claim 1, 2 or 3 in which the support means include leveling means secured perpendicular to the shaft portion whereby leveling of the said leveling means plumbs the shaft portion.

* * * * *